US009617784B2

(12) United States Patent
Houlihan

(10) Patent No.: US 9,617,784 B2
(45) Date of Patent: Apr. 11, 2017

(54) SAFETY SCREEN

(71) Applicant: Brian Houlihan, Lansing, IA (US)

(72) Inventor: Brian Houlihan, Lansing, IA (US)

(73) Assignee: Lansing Housing Products, Inc., Lansing, IA (US)

( * ) Notice: Subject to any disclaimer, the term of this patent is extended or adjusted under 35 U.S.C. 154(b) by 0 days.

(21) Appl. No.: 14/859,527

(22) Filed: Sep. 21, 2015

(65) Prior Publication Data

US 2016/0010387 A1 Jan. 14, 2016

Related U.S. Application Data

(63) Continuation-in-part of application No. 13/933,853, filed on Jul. 2, 2013, now abandoned.

(60) Provisional application No. 61/667,099, filed on Jul. 2, 2012.

(51) Int. Cl.

| | |
|---|---|
| ***E06B 9/52*** | (2006.01) |
| ***E06B 9/01*** | (2006.01) |
| *E06B 9/00* | (2006.01) |

(52) U.S. Cl.

CPC ..... *E06B 9/01* (2013.01); *E06B 9/52* (2013.01); *E06B 2009/002* (2013.01); *E06B 2009/015* (2013.01); *E06B 2009/524* (2013.01); *E06B 2009/527* (2013.01); *Y10T 29/4984* (2015.01)

(58) Field of Classification Search

CPC ..... E06B 9/02; E06B 2009/002; E06B 2009/524; E06B 2009/527

USPC ..... 160/327, 328, 354, 371, 380

See application file for complete search history.

(56) References Cited

U.S. PATENT DOCUMENTS

| | | | | |
|---|---|---|---|---|
| 584,148 | A * | 6/1897 | Robinson | E06B 9/52 15/215 |
| 2,709,489 | A * | 5/1955 | Keebler | E06B 9/52 160/381 |
| 7,302,986 | B2 * | 12/2007 | Flack, II | E06B 9/52 160/179 |
| 7,735,540 | B2 * | 6/2010 | Armstrong | E06B 9/52 160/280 |

FOREIGN PATENT DOCUMENTS

| | | |
|---|---|---|
| GB | 1254054 | * 11/1971 |

* cited by examiner

*Primary Examiner* — Blair M Johnson

(74) *Attorney, Agent, or Firm* — McCarter & English, LLP; Kia L. Freeman, Esq.

(57) ABSTRACT

A safety screen has four frame portions joined together to form a fall resistant window screen to prevent accidental egress from a window or door. Each frame portion has an upper frame portion and a lower frame portion integrally formed out of aluminum. A hinge channel runs longitudinally along a top portion of the upper frame portion and allows the upper frame portion to rotate around an integrally formed pivot slot that is longitudinally disposed at the vertex between the upper and lower frame portions. A U-shaped spline track may have a locking tab that snaps and locks within a frame hook portion that is located on many window and door frame extrusions. A screen is frictionally held in place when the upper frame is rotated and compressed against the lower frame. Each frame is mitered and welded together to form the safety screen.

15 Claims, 8 Drawing Sheets

SAFETY SCREEN

CROSS REFERENCE TO RELATED APPLICATIONS

This is a continuation in part of U.S. patent application Ser. No. 13/933,853, filed Jul. 2, 2013, which in turn claims priority to Provisional Application Ser. No. 61/667,099, filed on Jul. 2, 2012, the complete disclosures of each of which are hereby incorporated by reference.

BACKGROUND OF THE INVENTION

There are approximately five thousand reported cases of children falling out of a window every year in the United States alone. That amounts to about 14 children every day. The highest injury rate is among two year olds. While many windows are equipped with window screens, these are generally not strong enough to prevent falls.

Additionally, screen windows and doors can be expensive to replace when they break or the screen fails. Often the entire frame may have to be replaced or even the window or door if it is a custom size.

There is a need for a safety device that can prevent accidental falls from windows that is easy to use and economically feasible.

SUMMARY OF THE INVENTION

A snap and lock safety screen has four frame portions joined together to form a fall resistant window screen to prevent accidental egress from a window or door. Each frame portion has an upper frame portion and a lower frame portion integrally formed out of aluminum. A hinge channel runs longitudinally along a top portion of the upper frame portion and allows the upper frame portion to rotate around an integrally formed pivot slot that is longitudinally disposed at the vertex between the upper and lower frame portions. A U-shaped spline track has a locking tab that snaps and locks within a frame hook portion that is located on many window and door frame extrusions. A screen is frictionally held in place when the upper frame is rotated and compressed against the lower frame. Each frame is mitered and welded together to form the snap and lock safety screen.

Other features and advantages of the instant invention will become apparent from the following description of the invention which refers to the accompanying drawings.

DETAILED DESCRIPTION OF THE INVENTION

Figure 1:
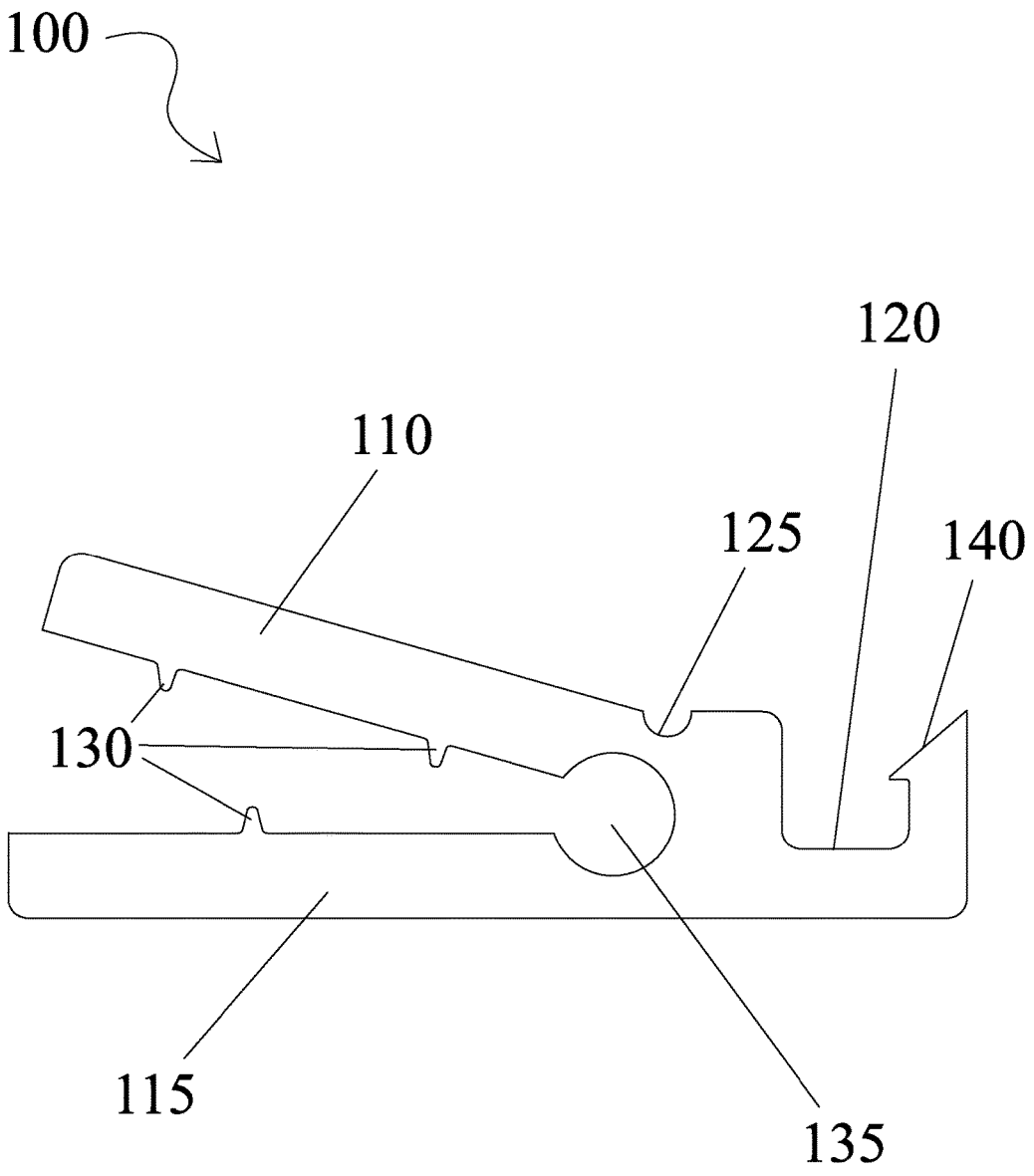
FIG. 1 is a side view of a cross-section of a snap and lock safety screen according to an embodiment of the present invention.
Figure 2:
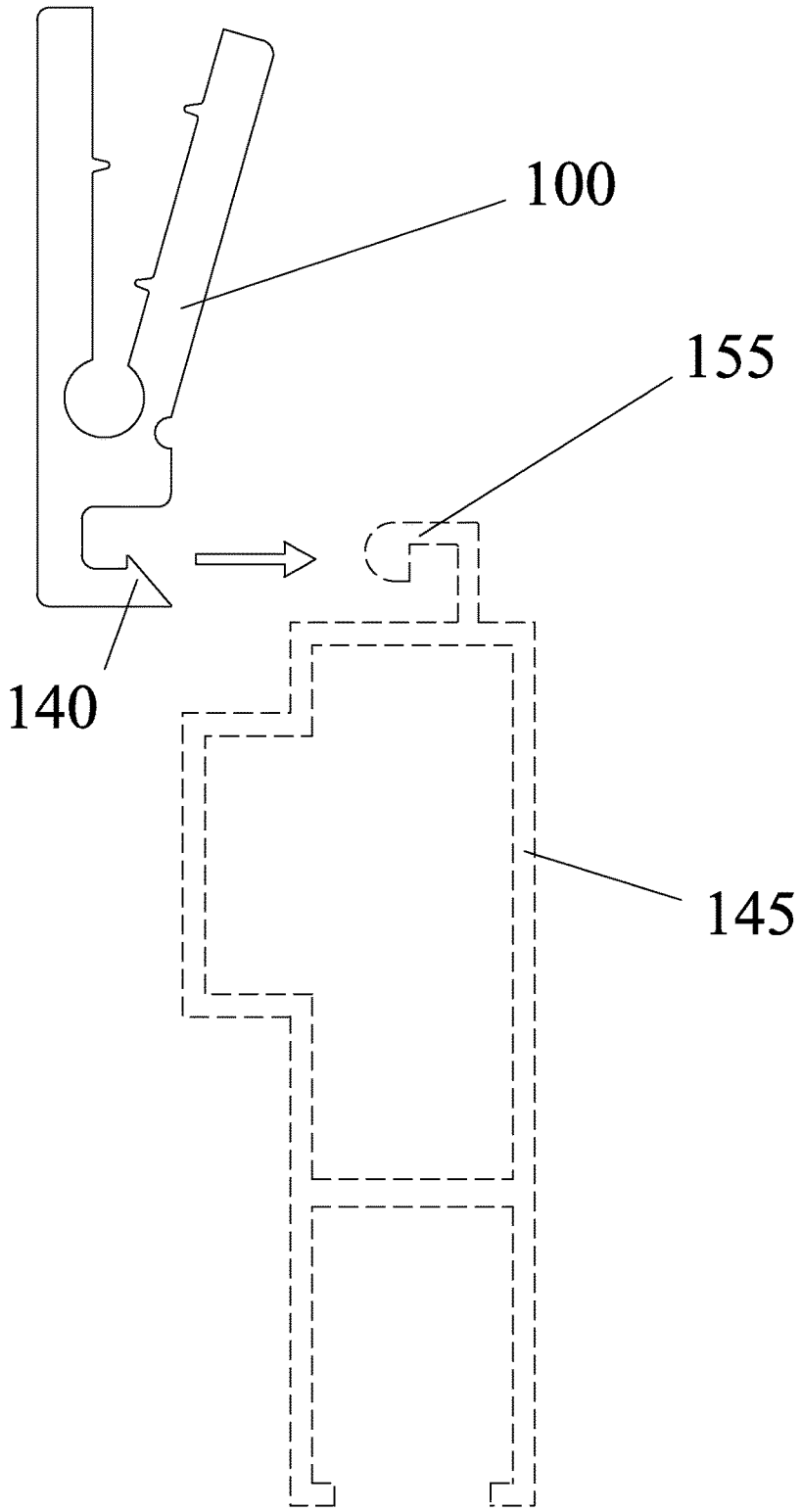
FIG. 2 is a cross-sectional view of the snap and lock safety screen shown in FIG. 1 being inserted in a frame.
Figure 3:
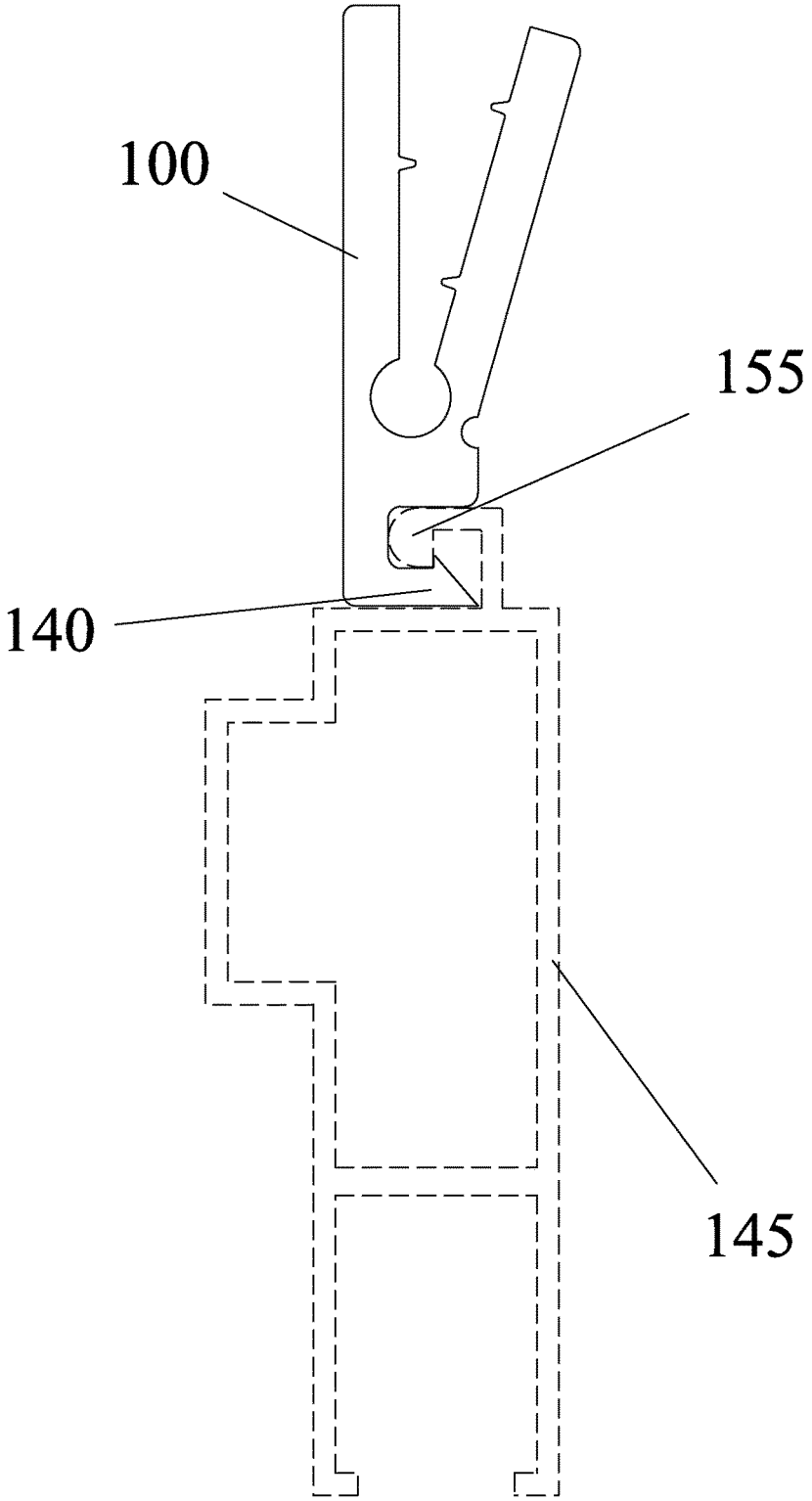
FIG. 3 is a cross-sectional view of the snap and lock safety screen shown in FIGS. 1 and 2, locked in place in the frame.
Figure 4:
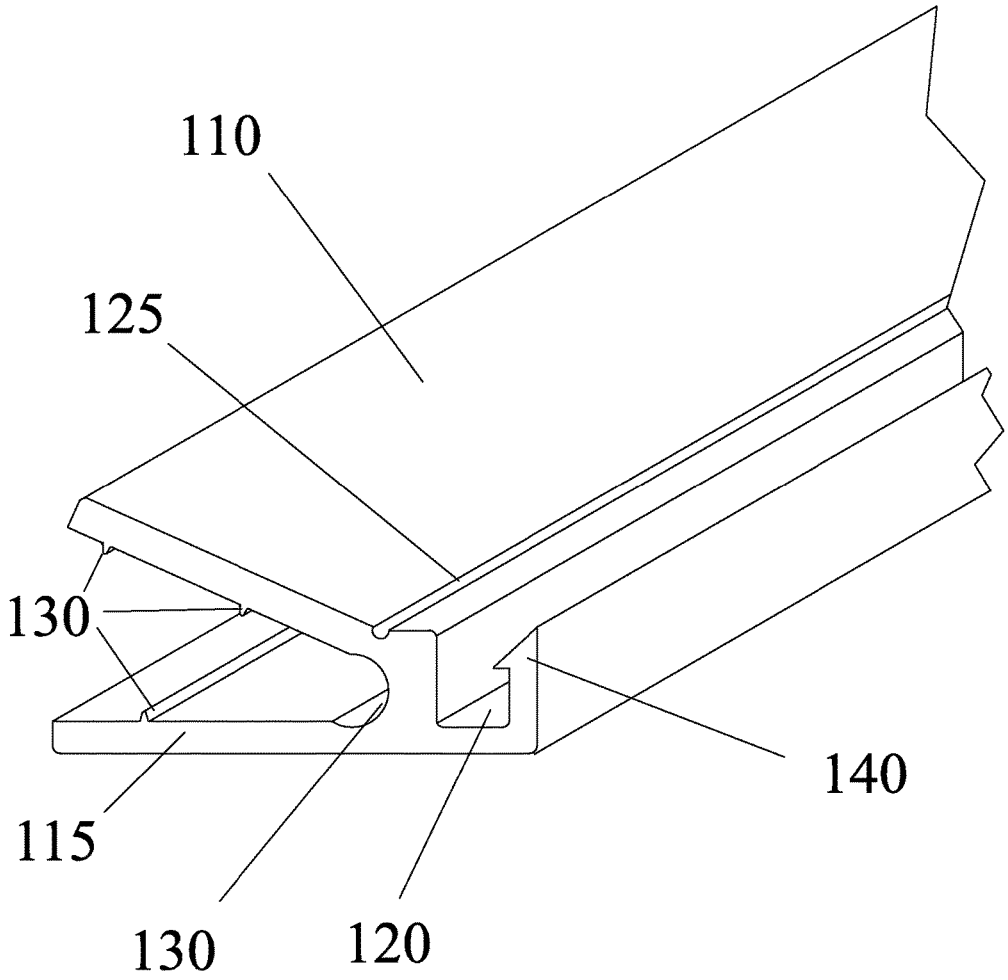
FIG. 4 is a perspective drawing of a portion of the snap and lock safety screen shown in FIG. 1.
Figure 5:
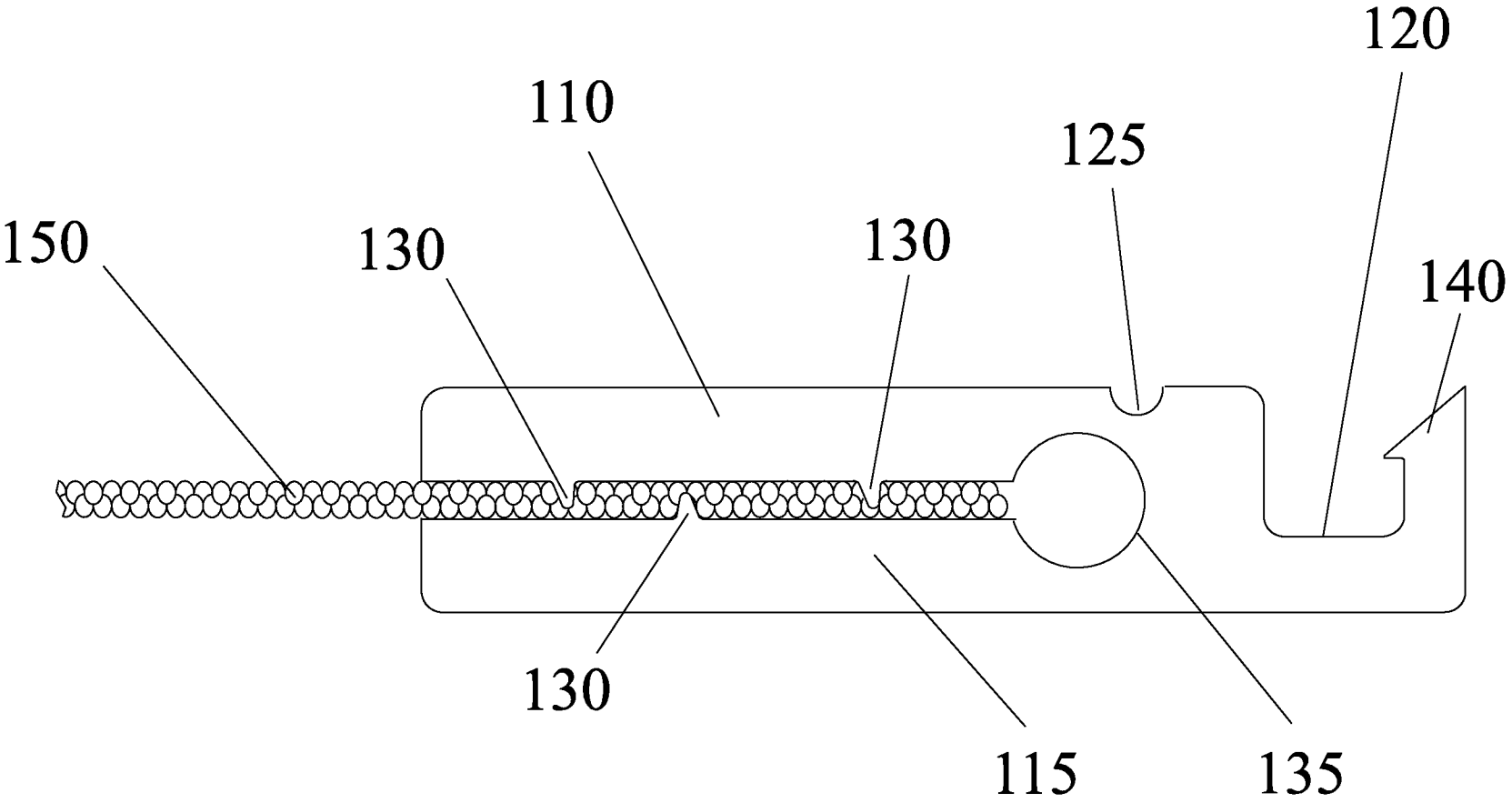
FIG. 5 is a cross-sectional view of the snap and lock safety screen shown in FIG. 1 with a screen installed.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to figures, a snap and lock safety screen 100 is shown having an upper frame portion 110 and a lower frame portion 115 hingedly joined around a pivot channel 135. A hinge channel 125 is provided to allow upper frame portion 110 to rotate without breaking when a safety screen 150 is inserted between upper frame portion 110 and lower frame portion 115 and is integrally formed with snap and lock safety screen 100. A plurality of compression ridges 130 are provided to securely hold safety screen 150 when upper frame portion 110 and lower frame portion 115 are rotated in the compressed position. The plurality of compression ridges 130 are integrally formed on an inner surface of upper frame portion 110 and a lower frame portion 115 and may be angled towards the outside of safety screen 100 to provide extra gripping strength. In addition to frictionally holding screen 150 in place as they are forced together, they also prevent over-compression of snap and lock safety screen 100.

A spline track portion 120 terminates in a locking tab 140 that fits within and locks in place in a frame hook portion that is located on a frame extrusion 145. Locking tab 140 is pushed against frame hook portion 155 and then resiliently snaps and locks into place securing it in place.

By snapping locking tab 140 in place, a person falling against screen 150 is prevented from accidentally falling through thus providing a safe screened door or window.

Figure 6:
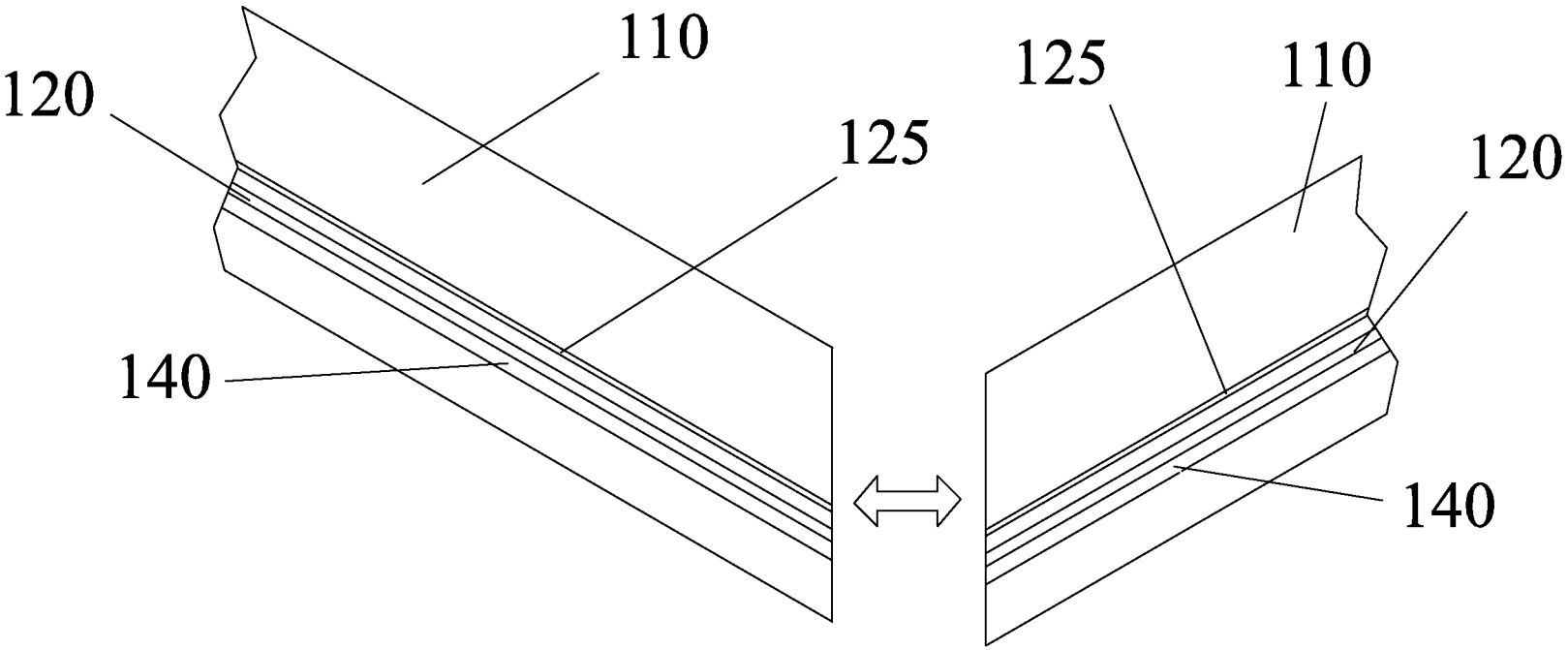
FIG. 6 is a perspective view of a selected corner portion before assembly.
Figure 7:
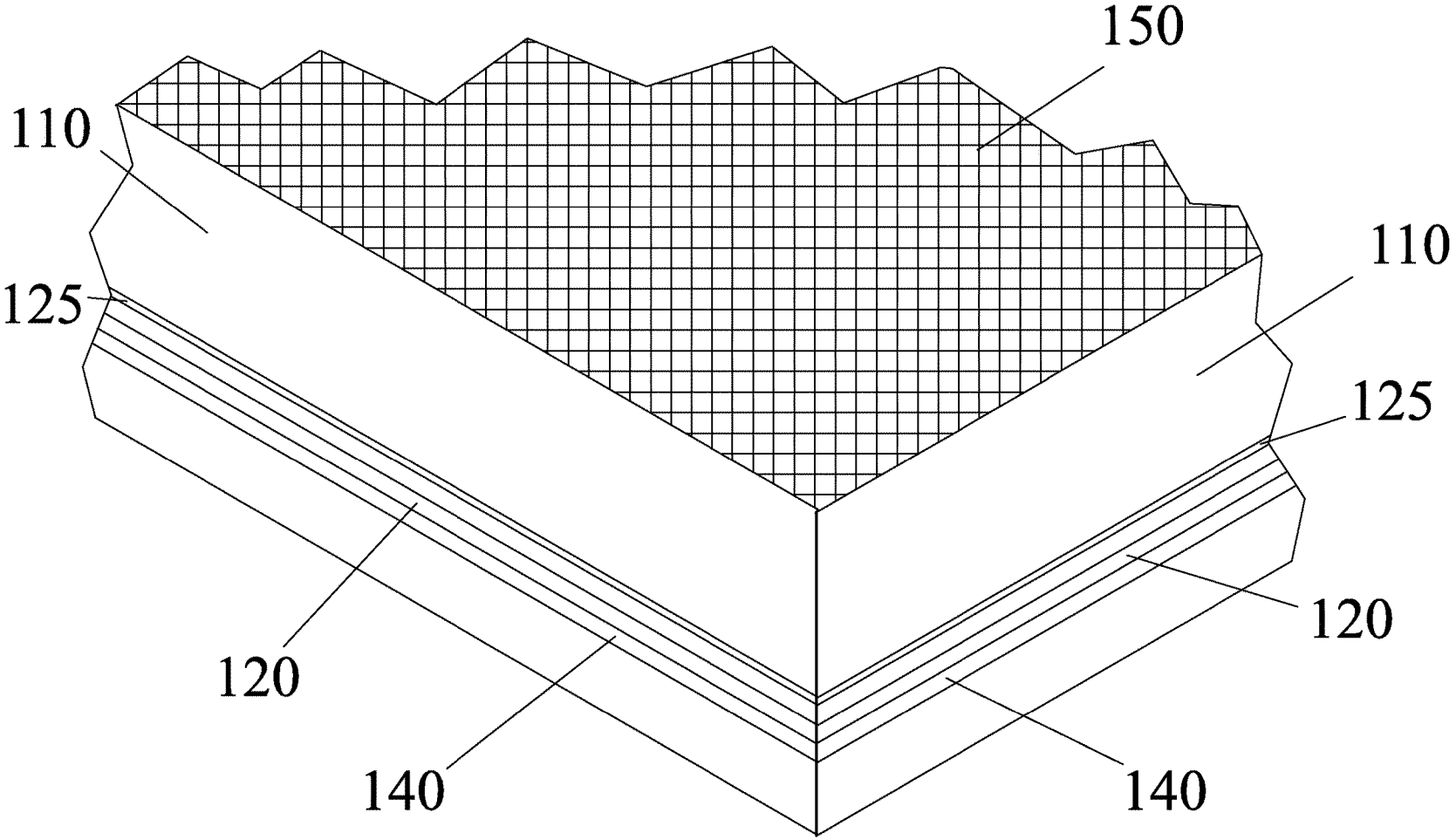
FIG. 7 is a perspective view of the selected corner portion shown in FIG. 6 after assembly.
Figure 8:
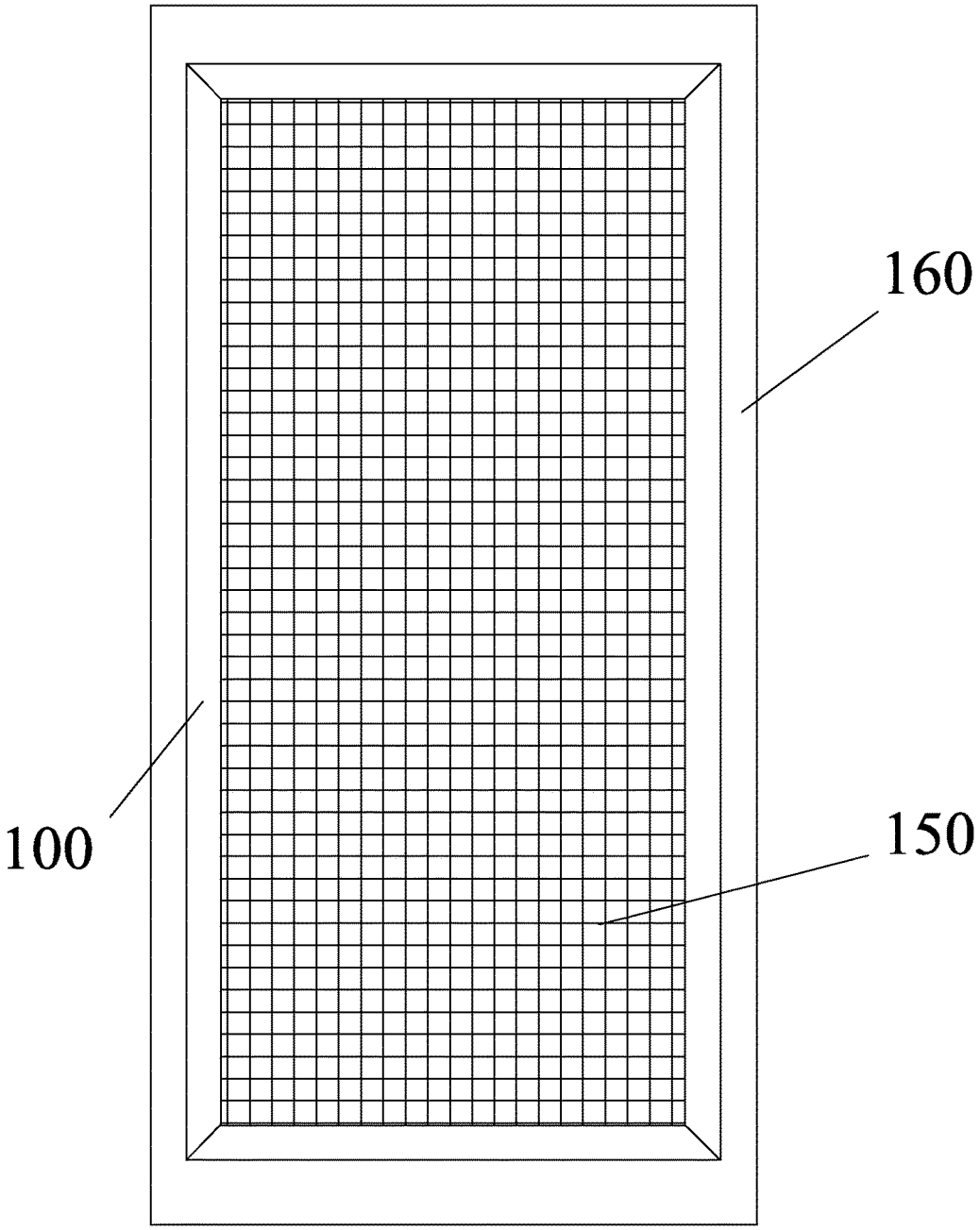
FIG. 8 is a front view of a snap and lock safety screen locked in the frame.

Referring now to FIGS. 6-7, a selected view of two safety frame portions 110 are shown with 90 degree mitered corners that fit together to form a window/door snap and lock safety screen 100. The mitered corners may be welded or mechanically joined together using known techniques.

Window/door frame 160 is shown with snap and lock safety screen 100 mounted within. Safety screen 100 fits within frame extrusion 145 and specifically frame hook portion 155 to secure it in place without the need for further installation hardware. Snap and lock safety screen 100 is locked into place using locking tab 140 as discussed above. Screen 150 protects children, pets or even adults from falling through the window.

Screen 150 is made of a high strength material such as stainless steel or synthetic material such as KEVLAR or other composite material having a high tensile strength to prevent a person from falling through. Screen 150 is placed within upper frame portion 110 and lower frame portion 115 and then upper frame portion is rotated into an installation position frictionally and securely holding screen 150 in place between the frame portions (110 and 115) by compression ridges 130. The instant invention does not require the screen to be welded in or the use of other mechanical fasteners to prevent the screen from failing if pushed on. Snap and lock safety screen 100 is made of extruded aluminum, however other materials may be used such as stainless steel, iron, etc. as long as hinge channel 125 can be integrally formed within while allowing the upper frame to permanently move in a compressed position. The frame may be painted or coated with plastic, vinyl or other surface enhancing material as is known in the art.

In addition to prevention of falling through the window, the instant invention is much more durable than traditional screens. This reduces maintenance costs for both windows and screen doors and reduces the overall cost of using the snap and lock safety screens over the lifetime of the window or door while providing peace of mind by protecting against accidental falls.

Snap and lock safety screen 100 fits within the frame portion of many commercially available windows and may be retro-fitted in those windows having an appropriate frame portion. Additionally, snap and lock safety screen 100 may be manufactured and sold with a matching window to provide for new installations having the safety functionality built in.

Although the instant invention has been described in relation to particular embodiments thereof, many other variations and modifications and other uses will become apparent to those skilled in the art.

What is claimed is:

1. A snap and lock safety screen for prevention of accidental egress comprising:

a snap and lock frame having four frame sides mitered and welded together;

each of said frame sides comprising:

an upper frame portion having at least one upper frame compression ridge disposed on an upper frame inner portion;

said upper frame portion having an upper frame portion outer edge;

a lower frame portion having at least one lower frame compression ridge disposed on a lower frame inner portion;

said lower frame portion having a lower frame portion outer edge;

a pivot channel disposed at a pivot point longitudinally disposed from said upper frame outer edge and said lower frame portion outer edge, wherein the pivot channel is generally circular;

a hinge channel disposed along an upper portion of said upper frame portion proximally disposed over said pivot channel, wherein said hinge channel enables said upper frame portion to rotate with respect to said lower frame portion about the pivot channel from an open position to a permanent compressed installation position;

a generally U-shaped spline track distally disposed to said upper frame portion and said lower frame portion;

a locking tab disposed on an open end of said spline track;

a screen adapted to fit within said snap and lock frame wherein said screen is held in place between said at least one upper frame compression ridge and said at least one lower frame compression ridge when said upper frame and said lower frame is rotated to a permanent compressed installation position;

a frame extrusion;

said frame extrusion having a frame hook portion; and said locking tab lockingly inserted within said frame hook portion wherein said snap and lock safety screen is securely held therein.

2. A safety screen for prevention of accidental egress comprising:

four extruded safety frame sections, each section comprising a cross-sectional profile that is substantially uniform along the length of the section and that varies in shape and thickness between edges of the cross-sectional profile across the width of the section, wherein the cross-sectional profile comprises;

a lower frame portion and an upper frame portion protruding from an upper edge of the lower frame portion when extruded;

wherein the upper frame portion forms an angle with respect to the lower frame portion when extruded;

wherein a vertex of the upper frame portion and the lower frame portion forms a substantially circular aperture, wherein the substantially circular aperture integrally forms a pivot channel between the upper frame portion and the lower frame portion along the length of the section, a concave arc on an upper edge of the upper frame portion, wherein the concave arc integrally forms a hinge channel along the length of the upper surface of the section;

wherein the concave arc reduces the thickness of the upper frame portion between the concave arc and the substantially circular aperture to allow the distal end of the upper frame portion to rotate towards the lower frame portion without breaking, and wherein the substantially circular aperture distributes the stress of the rotation, when the distal end of the upper frame portion rotates towards the lower frame portion, to maintain the structural integrity of the section;

wherein the lower frame portion comprises a spline track portion protruding from its upper edge, and wherein the spline track portion and the edges of the upper frame portion and the lower frame portion, which form the vertex, and a portion of the upper edge of the lower frame portion integrally form a spline track along the length of the section; and wherein the four safety frame sections comprise mitered ends welded together to form a rectangular safety screen frame; and a screen disposed within the safety screen frame to form a framed safety screen;

wherein the lower frame portion comprises at least one compression ridge protruding from its upper edge and the upper frame portion comprises at least one compression ridge protruding from its lower edge; and wherein the compression ridges hold the screen within the safety screen frame as a result of the rotation of the upper frame portion towards the lower frame portion into a permanent compressed position.

3. The safety screen of claim 2 wherein the stress of the rotation of the distal end of the upper frame portion towards the lower frame portion into an installation position causes permanent deformation in the frame section that enables the compression ridges to frictionally hold the screen within the frame.

4. The safety screen of claim 2 wherein no mechanical fastener other than the frame sections are used to hold the screen within the safety screen frame.

5. The safety screen of claim 2 wherein no weld other than the welding of the mitered ends of the four frame sections is used to hold the screen within the safety screen frame.

6. The safety screen of claim 2 wherein each safety frame section comprises extruded aluminum.

7. The safety screen of claim 2 wherein the screen comprises stainless steel.

8. The safety screen of claim 2 wherein the cross-sectional profile comprises no protrusion on the lower edge of the upper frame portion that corresponds to the concave arc.

9. The safety screen of claim 2 wherein the cross-sectional profile of each frame section further comprises at least one compression ridge on a lower edge of the upper frame portion with no corresponding concavity on the upper edge of the upper frame portion.

10. The safety screen of claim 2 wherein the cross-sectional profile of each frame section further comprises at least one compression ridge on a lower edge of the upper frame portion that protrudes toward the vertex of the upper frame portion and the lower frame portion.

11. The safety screen of claim 2 wherein the cross-sectional profile of each frame section further comprises a plurality of compression ridges on a lower edge of the upper frame portion with no corresponding concavity on the upper edge of the upper frame portion.

12. The safety screen of claim 2 wherein the cross-sectional profile of each frame section further comprises at least one compression ridge on an upper edge of the lower frame portion with no corresponding concavity on the lower edge of the lower frame portion.

13. The safety screen of claim 2 wherein the cross-sectional profile of each frame section further comprises at least one compression ridge on an upper edge of the lower frame portion that protrudes toward the vertex of the upper frame portion and the lower frame portion.

14. The safety screen of claim 2 wherein the cross-sectional profile of each frame section further comprises a plurality of compression ridges on an upper edge of the lower frame portion with no corresponding concavity on the lower edge of the lower frame portion.

15. The safety screen of claim 2 wherein the rectangular safety screen frame further comprises corner keys that reinforce the joints between the frame sections.

* * * * *